United States Patent [19]

Delaey

[11] 4,437,911

[45] Mar. 20, 1984

[54] BETA ALLOYS WITH IMPROVED PROPERTIES

[75] Inventor: Lucas J. Delaey, Bertem, Belgium

[73] Assignee: Leuven Research & Development V.Z.W., Louvain, Belgium

[21] Appl. No.: 400,017

[22] Filed: Jul. 20, 1982

[30] Foreign Application Priority Data

Jul. 30, 1981 [NL] Netherlands ..... 8103612

[51] Int. Cl.[3] ..... C22C 9/04; C22F 1/08

[52] U.S. Cl. ..... 148/402; 148/12.7 C; 148/413; 420/478

[58] Field of Search ..... 148/11.5 C, 12.7 C, 148/434, 413, 436, 402; 420/478, 484

[56] References Cited

U.S. PATENT DOCUMENTS 3,297,497 1/1967 Eichelman, Jr. ..... 148/12.7 C 3,544,313 12/1970 Sadoshima et al. ..... 148/434

4,249,942 2/1981 Shapiro et al. ..... 148/11.5 C

*Primary Examiner*—Peter K. Skiff

*Attorney, Agent, or Firm*—Fred Philpitt

[57] ABSTRACT

An aluminum bearing beta copper alloy that on heating to a first temperature shows a transition from an (alpha+beta)-region, an (alpha+beta+gamma)-region or a (beta+gamma)-region to a beta-region.

Its average grain size is less than 200 μm and it contains aluminium bearing precipitates, e.g. Co-Al-precipitates, the average size of which is less than 10 μm and which are insoluble in the alloy below a second temperature that is higher than said first temperature.

The fine grain structure guarantees an excellent mechanical and thermomechanical behavior of the alloy, while the aluminium bearing precipitates guarantee that this structure and hence the advantageous behavior of the alloy is maintained as long as the alloy is not heated to said second temperature.

12 Claims, 2 Drawing Figures

BETA ALLOYS WITH IMPROVED PROPERTIES

Figure 1:
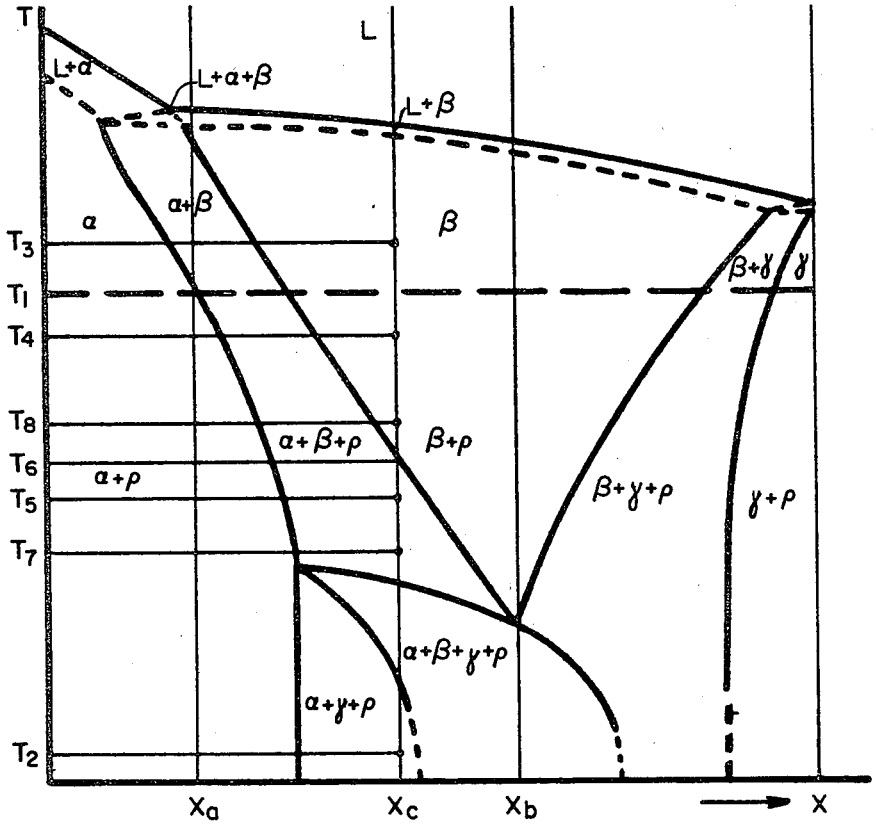

The invention relates to an aluminium bearing beta copper alloy with improved mechanical and thermomechanical properties, as well as to a process for the preparation of such alloy.

It is known that aluminium bearing copper alloys such as copper-zinc-aluminium alloys may occur in different crystal modifications, a.o. an alpha-, a beta- and a gammamodification and that such alloys with beta crystal structure present special properties such as pseudo-elasticity, shape memory, reversible shape memory and good damping properties.

Pseudo-elasticity means that, if a solid body of the alloy is subjected to a mechanical load above the so-called Af-temperature, it will show an elastic elongation that is much higher than with other metals and in any case higher than at temperatures below Af. This elastic elongation disappears upon removal of the load.

Shape memory effect means that a solid body of the alloy, after mechanical deformation at a temperature below the so-called Ms-temperature, will spontaneously resume its original shape, merely by heating to above said Af-temperature.

A reversible shape memory effect is shown when the shape memory effect has been used many times, e.g. 20 times, in succession. A solid body of the alloy, when cooled to below the Ms-temperature, will then show a spontaneous deformation without applying any external mechanical load, which deformation can be undone by heating above the aforementioned Af-temperature.

Said phenomena are ascribed to martensitic transformations, i.e. the reversible growth and disappearance of martensite platelets within the crystal structure of the alloy.

By Ms-temperature is meant the temperature at which the first martensite platelets are formed during cooling of the data phase, and by Af-temperature the temperature at which the last martensite platelets disappear during heating.

The most interesting aluminium bearing beta copper alloys are those which on heating show a transition from an (alpha+beta)-region to a beta-region. Aluminium bearing beta copper alloys which on heating show a transition from an (alpha+beta+gamma)-region or a (beta+gamma)-region to a beta-region may, however, also be of a certain importance.

The application of aluminium bearing beta copper alloys is impeded by the inferior mechanical and thermomechanical properties, e.g. the low resistance to fatigue, shown in most cases by these alloys in the wrought state, especially after additional thermal treatments. During these treatments there is a considerable grain growth in the alloy, which is responsible for the deterioration of said properties.

Through German patent application No. 2837339 it is already known to add 0.5–4% by weight of nickel to beta copper-zinc-aluminium alloys in order to obtain a grain that is slightly larger than 200 μm and to counteract grain growth. It has been stated, however, that this addition of nickel slows down the grain growth but does not exclude it.

The invention aims at providing an aluminium bearing beta copper alloy of the above mentioned type with excellent mechanical and thermomechanical properties and that can be heat treated without impairing these properties.

The alloy according to the invention, that on heating to a first temperature shows a transition from an (alpha+beta)-region, an (alpha+beta+gamma)-region or a (beta+gamma)-region to a beta-region, is characterized in that its average grain size is less than 200 μm and in that it contains aluminium bearing precipitates, the average size of which is less than 10 μm and which are insoluble in the alloy below a second temperature that is higher than said first temperature.

The fine grain structure guarantees an excellent mechanical and thermomechanical behaviour of the alloy, while the aluminium bearing precipitates guarantee that this structure and hence the advantageous behaviour of the alloy is maintained as long as these precipitates are not destroyed, i.e. as long as the alloy is not heated to said second temperature.

In comparison with the already known alloys, the alloy according to the invention still has the additional advantage that its Ms-temperature is not exclusively determined by its composition, as will be explained hereafter.

The aluminium bearing precipitates have preferably an average size of less than 5 μm.

The alloy according to the invention contains, of course, a suitable aluminium precipitating component such as e.g. cobalt, palladium, platinum, a mixture of these elements or a mixture of these elements with other elements such as titanium, chromium and nickel.

As a matter of fact the alloy should contain enough of this component to form aluminium bearing precipitates. The applicant found that an addition of 0.01 wt.% of said component is already active but that an addition of at least 0.1 wt. % is preferred. It will be noticed that said second temperature increases with the content of the aluminium precipitating component. Hence, this content will thus be chosen according to the heat treatment that the alloy will have to undergo. It is advisable, however, not to add more than 2 percent by weight of said elements since it was stated that in that case it is not possible to avoid the formation of large aluminium bearing precipitates which may inpair the ductility of the alloy. In most cases it is not advantageous to add more than 1 percent by weight of said elements.

Apart from the aluminium precipitating component and from unavoidable impurities, the alloy according to the invention may e.g. contain 4–40 wt. % Zn, 1–12 wt. % Al, 0–8 wt. % Mn, 0–4 wt. % Ni and the balance of Cu.

The invention relates also to a process for the preparation of the alloy according to the invention.

The process according to the invention is characterized in that as a starting material is used an aluminium bearing copper alloy, which on heating to a first temperature shows a transition from an (alpha+beta)-region, an (alpha+beta+gamma)-region or a (beta+gamma)-region to a beta-region and which contains an aluminium precipitating component that dissolves in the alloy at a second temperature that is higher than said first temperature, and in that this starting alloy is converted into a quenched beta alloy, the average grain size of which is less than about 200 μm and which contains aluminium bearing precipitates, the average size of which is less than 10 μm.

For economical reasons the starting alloy is preferably a cast alloy but could also be a powder metallurgy alloy.

It is obvious that aluminium bearing precipitates are already present in the starting alloy, provided of course that its temperature is lower than said second temperature, and that the average size of these precipitates may be less than or exceed 10 μm according to the method by which the starting alloy was produced, e.g., by fast or slow cooling of a melt.

A number of possible modes for carrying out the process of the invention, which can be applied when the starting alloy contains aluminium bearing precipitates, the average size of which is at least 10 μm, comprises the following steps:

(a) the starting alloy is heated in the beta-region to at least said second temperature whereafter the alloy is cooled in such a way that aluminium bearing precipitates are formed, the average size of which is less than 10 μm, preferably less than 5 μm;

(b) the alloy containing said precipitates is deformed below said second temperature in such a way that its average grain size becomes less than about 200 μm; and (c) the deformed alloy is quenched out of the beta-region from a third temperature that is lower than said second temperature, whereby obtaining a fine-grained beta meterial, the Ms-temperature of which depend for a given composition on a said third temperature.

In a first mode of carrying out the process of the invention a hot deformation is applied in step (b) at the temperature, from which quenching will be carried out in step (c) and thereafter one proceeds immediately to step (c).

In a second embodiment, a hot deformation is applied in step (b) at a temperature at which the alloy is in the (alpha+beta)-region, the deformed alloy is annealed at the temperature, from which quenching will be carried out in step (c) whereafter one proceeds immediately to step (c). In a variant to this embodiment the hot deformed alloy is quenched before annealing.

In a third embodiment the alloy resulting from step (a) is heated in the (alpha+beta)-region in such a way that the heated alloy contains at least 20 percent, preferably at least 30 percent, alpha crystals, the alloy is quenched, the quenched alloy is subjected to a deformation in step (b) below said first temperature, it is then annealed at the temperature from which quenching will be carried out in step (c), and then one proceeds immediately to step (c).

In a fourth embodiment, that is also applicable when the starting alloy contains aluminium bearing precipitates, the average size of which is at least 10 μm, the starting alloy is heated to at least said second temperature, deformed at this temperature in such a way that its average grain size becomes less than about 200 μm and the deformed material is immediately quenched. If necessary the Ms-temperature of the so obtained material can be adjusted by annealing at an appropriate temperature between said first and said second temperature, whereafter it is quenched again.

A number of embodiments applicable when the starting alloy contains aluminium bearing precipitates, the average size of which is already less than 10 μm, comprises following steps:

(a') the starting alloy is deformed below said second temperature in such a way that its average grain size becomes less than about 200 μm; and (b') the deformed alloy is quenched out of the beta-region from a third temperature that is lower than said second temperature, whereby obtaining a fine-grained beta material, the Ms-temperature of which depends for a given composition on said third temperature.

In a fifth embodiment a hot deformation is applied in step (a') at the temperature, from which quenching will be carried out in step (b') and thereafter one proceeds immediately to step (b').

In a sixth embodiment a hot deformation is applied in step (a') at a temperature at which the starting alloy is in the (alpha+beta)-region, the deformed alloy is annealed at the temperature, from which quenching will be carried out in step (b') and thereafter one proceeds immediately to step (b'). In a variant to this embodiment the hot deformed alloy is quenched before annealing.

In a seventh embodiment the starting alloy is heated in the (alpha+beta)-region in such a way that the heated alloy contains at least 20 percent, preferably at least 30 percent alpha crystals, this alloy is quenched, the quenched alloy is subjected to a deformation in step (a') below said first temperature, it is then annealed at the temperature from which quenching will be carried out in step (b') and then one proceeds immediately to step (b').

Figure 2:
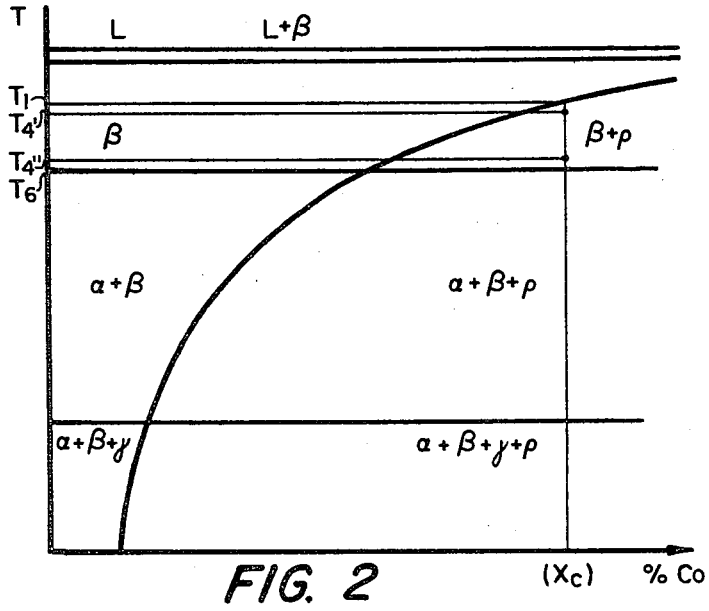

For a better understanding of the alloy and the process according to the invention, reference is made to the accompanying drawing in which FIG. 1 represents a schematic phase diagram for alloys related to the invention with a given content of the aluminium precipitating component, and FIG. 2 represents such a diagram for a varying content of the aluminium precipitating component.

The diagrams of FIGS. 1 and 2 are in fact plotted from data on copper-zinc-aluminium alloys with a low cobalt content, but are generally valid for all aluminium bearing copper alloys with a low content of an aluminium precipitating component, that show alpha-, beta- and possibly gamma-crystal modifications. Since the diagrams intend to give only a schematic view, no numerical values are indicated on the axes.

The phase diagram of FIG. 1, based on a series of alloys with constant cobalt content, represents the crystal modifications that can occur in the alloys of the invention, at various temperatures (T) and various compositions in % (X). A.o., a beta-region and an (alpha+-beta)-region are shown, in which aluminium- and cobalt bearing precipitates (p) occur below temperature T1.

Temperature T1 increases with the cobalt content as appears from the phase diagram of FIG. 2 that is based on a series of alloys in which only the copper- and cobalt contents varied.

The invention especially relates to alloys that can be transferred by heating from the (alph+beta)-region to the beta-region, i.e. to alloys with a composition X situated between the limits Xa and Xb on FIG. 1.

As a starting material can be used e.g. an alloy of composition Xc that is at room temperature T2.

When applying the above described first, second and third embodiments, this starting material is then heated to at least temperature T1, e.g. to temperature T3 and is kept long enough at this temperature to bring the cobalt, i.e. the precipitates (p) in solution, whereafter the material is cooled down fast enough to below temperature T1, e.g. to temperature T2 so as to form precipitates (p), the average size of which is less than 10 μm and preferably less than 5 μm.

In the first embodiment the material with the fine precipitates (p) is then heated into the beta-region to a temperature that is lower than T1, e.g. to T4, whereafter the material is deformed at T4 and immediately thereafter quenched to e.g. temperature T2.

In the second embodiment the material with the fine precipitates (p) is heated into the (alpha+beta)-region, e.g. to temperature T5, it is deformed at this temperature and then annealed at temperature T4 to convert the alpha crystals into beta crystals, whereafter the material is quenched to e.g. temperature T2.

In the third embodiment the material with the fine precipitates (p) is heated in the (alpha-beta)-region at a temperature, e.g. at temperature T7, that is substantially lower than temperature T6 at which the (alpha+beta)-region passes into the beta-region so as to form a substantial amount of cold deformable alpha crystals, whereafter the material is quenched to temperature T2 and then cold deformed, whereafter it is annealed at temperature T4 and quenched again to temperature T2.

When applying the above described fourth embodiment the starting material is heated to at least temperature T1, e.g. to temperature T3, it is kept long enough at this temperature to bring the cobalt, i.e. the precipitates (p) in solution, for instance for 15 minutes, it is deformed at the same temperature T3 and the deformed material is immediately quenched to below temperature T1, e.g. to temperature T2.

When applying the above described fifth, sixth and seventh embodiments one proceeds in the same way as in respectively the first, second and third embodiment after obtaining a material in which the precipitates have an average grain size of less than 10 μm.

Temperature T1 can be determined experimentally. One can e.g. proceed as follows. A sample of the starting alloy Xc is melted and the molten sample is granulated in water. The granules obtained in this way consist of course of a material with fine grain structure, that contains very fine precipitates. The grain structure of a granule is controlled. The granule is then heated in the beta-region not too far above temperature T6, e.g. at T8, for 15 minutes. The heated granule is quenched to temperature T2 and the grain structure of the quenched granule is controlled again. It is noted that the grain of the granule did not grow during the heat temperature at T8. This test is then repeated, several times if necessary, T8 being raised each time by 10° C., until it is stated that heating at T8 causes grain growth, which means that the last used T8 corresponds to T1.

When T1 is determined, the operating conditions to be observed in the process according to the invention can be easily established experimentally, e.g. the conditions leading to the formation of fine precipitates (p) such as the optimum duration of stay at T1 or above T1, the optimum cooling rate and the optimum temperature to which should be cooled.

FIG. 2 illustrates the importance of temperature T4, i.e. the temperature at which the alloy is hot deformed or annealed before being quenched in step (c) or step (b'). If T4 is close to T1, e.g. at T4', there will be in the quenched end-product substantially less aluminium in the form of precipitates (p) than if T4 is near T6, e.g. at T4''. The result is that the Ms-temperature of the end-product obtained in the first case, differs clearly from the one of the end-product obtained in the second case, although in both cases one started with the same composition Xc. Hence, the process according to the invention enables, for a given composition of the starting alloy, to adjust to some extent the Ms-temperature.

EXAMPLE 1

The starting material is an ingot of 10 cm diameter and with the following analysis: 73.93% Cu; 19.45% Zn; 5.94% Al; 0.42% Co plus impurities.

The cobalt- and aluminium bearing precipitates in this casting are on an average smaller than 5 μm. The transition from alpha+beta to beta (T6) is at about 615° C. and the temperature at which the precipitates dissolve (T1) is at about 825° C.

A 9 mm thick slice is sawn from the ingot.

This slice is rolled in five steps to a plate of 1 mm thickness at a temperature between 500° and 570° C., i.e. in the (alpha+beta)-region (T5).

From the so obtained plate that has an average grain size of about 80 μm, flat samples are cut for fatigue tests. These samples are annealed for 15 minutes at 650° C. (T4) and then quenched in water (T2).

The quenched samples, which like said plate have also an average grain size of 80 μm, are tested on fatigue. Therefore they are subjected to a sinusoidally changing load with a minimum value of 5 MPa and a maximum value of 405 MPa in a first case, 370 MPa in a second case, 350 MPa in a third case and 300 MPa in a fourth case. In the first case the sample withstands 21,000 cycles, in the second case 46,000 cycles, in the third case 64,000 cycles and in the fourth case 150,000 cycles.

These values are substantially higher than the values obtained with cast Cu-Zn-Al alloys without cobalt addition, in the hot rolled state. By way of comparison reference is made to fatigue tests described in "Proceedings ICSMA 1979", page 1125–30, and carried out on samples with the same geometry. In that case hot rolled samples are tested which were made from an ingot with following composition; 74.3% Cu; 18.7% Zn; 7% Al. These samples withstood at a maximum load of 380 MPa only 1,000 cycles, at a maximum load of 240 MPa only 10,000 cycles and at a maximum load of 170 MPa only 100,000 cycles.

EXAMPLE 2

Two samples are cut from the plate obtained in example 1.

The first sample is annealed for 15 minutes at 650° C. and then quenched. The Ms-temperature of the quenched sample is 82° C.

The second sample is annealed for 15 minutes at 750° C. and then quenched. This sample has an Ms-temperature of 72° C.

This example illustrates the afore discussed importance of temperature T4 in the process of the invention.

EXAMPLE 3

As a starting material is used an ingot of 8.5 cm diameter and with the following composition: 74.9% Cu; 16.4% Zn; 7.8% Al; 0.9% Co.

The diameter of the ingot is reduced to 6.9 cm by turning on the lathe.

The ingot is then heated for 24 hours at 900° C., whereafter it is cooled in the oven in such a way that its temperature decreases to 550° C. in 4 hours. With this operation, the production of large ingots on an industrial scale is simulated.

The ingot is then heated to 750° C., extruded to a rod of 1.25 cm diameter and immediately quenched in water.

The quenched material has a little alpha phase and it shows an average grain size of 100 μm. The cobalt- and aluminium bearing precipitates in this quenched material are on an average larger than 10 μm (about 13 μm).

The transition from alpha+beta to beta (T6) is at about 670° C. and the temperature at which the precipitates dissolve (T1) is at about 880° C.

A sample of the quenched material is heated for 30 minutes at 750° C. and then quenched in water. The resulting material is wholly beta and it has an average grain size of 500 μm.

EXAMPLE 4

The same mode of operation as in example 3 is used, but after the turned ingot has been heated for 24 hours at 900° C., it is cooled to 850° C. in 15 minutes, whereafter it is extruded to a rod of 1.25 cm diameter which is immediately quenched in water.

As in example 3 the quenched material has a little alpha phase and it shows an average grain size of 100 μm, but the cobalt- and aluminium bearing precipitates are now on an average smaller than 10 μm (about 3 μm).

T6 and T1 are the same as in example 3.

A sample of the quenched material is heated for 30 minutes at 750° C. and then quenched in water. The result is a wholly beta material with an average grain size of 100 μm.

Examples 3 and 4 illustrate the essential influence of the average grain size of the aluminium bearing precipitates on the grain growth in the alloy: above 10 μm there is grain growth; below 10 μm there is no grain growth.

I claim:

1. A shape memory beta copper alloy with improved fatigue strength properties and with an adjustable Ms-temperature, consisting essentially of 4–40% by weight of Zn, 1–12% by weight of Al, 0.01–2% by weight of Co, 0–8% by weight of Mn, 0–4% by weight of Ni and the balance Cu, said alloy showing on heating to a first temperature a transition from an (alpha+beta)-region, an (alpha+beta+gamma)-region or a (beta+gamma)-region to a beta-region, said alloy having an average grain size of less than 200 μm and containing cobalt- and aluminium bearing precipitates, the average size of which is less than 10 μm and which are insoluble in the alloy below a second temperature that is higher than said first temperature.

2. A shape memory beta copper alloy with improved fatigue strength properties and with an adjustable Ms-temperature, consisting essentially of 4–40% by weight of Zn, 1–12% by weight of Al, 0.01–2% by weight of a mixture of Co with Ti, 0–8% by weight of Mn, 0–4% by weight of Ni and the balance Cu, said alloy showing on heating to a first temperature a transition from an (alpha+beta)-region, an (alpha+beta+gamma)-region or a (beta+gamma)-region to a beta-region, said alloy having an average grain size of less than 200 μm and containing cobalt-, titanium- and aluminium bearing precipitates, the average size of which is less than 10 μm and which are insoluble in the alloy below a second temperature that is higher than said first temperature.

3. An alloy according to claim 2, characterized in that it contains 0.1–1% by weight of said mixture.

4. A process for the preparation of an alloy according to claim 1, comprising using as a starting material an alloy, which consists essentially of 4–40% by weight of Zn, 1–12% by weight of Al, 0.01–2% by weight of Co, 0–8% by weight of Mn, 0–4% by weight of Ni and the balance Cu and which on heating to a first temperature shows a transition from an (alpha+beta)-region, an (alpha+beta+gamma)-region or a (beta+gamma)-region to a beta-region, and converting this starting alloy into a quenched beta alloy, the average grain size of which is less than 200 μm and which contains cobalt- and aluminium bearing precipitates, the average size of which is less than 10 μm.

5. A process for the preparation of an alloy according to claim 2, comprising using as a starting material an alloy, which consists essentially of 4–40% by weight of Zn, 1–12% by weight of Al, 0.01–2% by weight of a mixture of Co with Ti, 0.8% by weight of Mn, 0–4% by weight of Ni and the balance Cu and which on heating to a first temperature shows a transition from an (alpha+beta)-region, an (alpha+beta+gramma)-region or a (beta+gamma)-region to a beta-region, and converting this starting alloy into a quenched beta alloy, the average grain size of which is less than 200 μm and which contains cobalt-, titanium- and aluminium bearing precipitates, the average size of which is less than 10 μm.

6. An alloy according to claim 1 or claim 2 characterized in that said precipitates have an average size of less than 5 μm.

7. An alloy according to claim 1 characterized in that it contains 0.1–1% by weight of cobalt.

8. A process according to claim 4 or claim 5 characterized in that the conversion of the starting alloy into the quenched fine-grained beta alloy comprises the following steps:

(a) the starting alloy is heated in the beta-region to at least said second temperature, whereafter the alloy is cooled in such a way that said precipitates are formed;

(b) the alloy containing said precipitates is deformed below said second temperature in such a way that its average grain size becomes less than 200 μm; and (c) the deformed alloy is quenched out of the beta-region from a third temperature that is lower than said second temperature, whereby obtaining a fine-grained beta material, the Ms-temperature of which depends for a given composition on said third temperature.

9. A process according to claim 8 characterized in that in step (a) precipitates are formed, the average size of which is less than 5 μm.

10. A process according to claim 4 or claim 5 characterized in that the starting alloy is converted into the quenched fine-grained beta alloy by deforming the starting alloy at at least said second temperature in such a way that its average grain size becomes less than 200 μm and by quenching immediately the deformed material.

11. A process according to claim 10 characterized in that the quenched alloy is annealed in the beta-region at a third temperature that is lower than said second temperature, whereby obtaining, after quenching, a fine-grained beta material the Ms-temperature of which depends for a given composition, on said third temperature.

12. A process according to claim 4 or claim 5 characterized in that the conversion of the starting alloy into the quenched fine-grained beta alloy comprises the following steps:

(a) the starting alloy is deformed below said second temperature in such a way that its average grain size becomes less than 200 μm; and (b) the deformed alloy is quenched out of the beta-region from a third temperature that is lower than said second temperature, whereby obtaining a fine-grained beta material, the Ms-temperature of which depends for a given composition on said third temperature.

* * * * *